US008822891B2

(12) United States Patent
Sudo et al.

(10) Patent No.: US 8,822,891 B2
(45) Date of Patent: Sep. 2, 2014

(54) SHEET HEATER AND IMAGE FIXING DEVICE INCLUDING THE SHEET HEATER

(71) Applicant: Konica Minolta, Inc., Tokyo (JP)

(72) Inventors: Susumu Sudo, Tokyo (JP); Eiichi Yoshida, Tokyo (JP); Izumi Mukoyama, Tokyo (JP); Junji Ujihara, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/966,354

(22) Filed: Aug. 14, 2013

(65) Prior Publication Data

US 2014/0061181 A1 Mar. 6, 2014

(30) Foreign Application Priority Data

Aug. 29, 2012 (JP) ..... 2012-188464

(51) Int. Cl.
*H05B 3/02* (2006.01)
*G03G 15/054* (2006.01)
*G03G 15/20* (2006.01)

(52) U.S. Cl.
CPC ..... *G03G 15/054* (2013.01); *G03G 15/2057* (2013.01)
USPC ..... 219/538; 399/328; 427/123

(58) Field of Classification Search
USPC ..... 219/538; 399/333; 427/123, 125
See application file for complete search history.

(56) References Cited

U.S. PATENT DOCUMENTS

2013/0149439 A1* 6/2013 Ujihara et al. ..... 427/123

FOREIGN PATENT DOCUMENTS

| | | | |
|---|---|---|---|
| JP | 2006-294604 | A | 10/2006 |
| JP | 2009-092785 | A | 4/2009 |
| JP | 2009-109987 | A | 5/2009 |
| JP | 2012-037823 | A | 2/2012 |

* cited by examiner

*Primary Examiner* — Shawntina Fuqua
(74) *Attorney, Agent, or Firm* — Lucas & Mercanti, LLP

(57) ABSTRACT

A sheet heater that includes a sheet article composed of a conductive resin composition containing a conductive material and a resin, and a pair of metal plate electrodes, each of the electrodes being bonded to each of the ends of the sheet article, wherein when elements of the sheet article are detected at a portion 1 μm depth from a surface of the metal plate electrode, a peak area ratio of silicon (Si) to metal ion (M) is 1/100 to 1, the metal ion M being most abundant of all metal ions detected at the portion, the peaks being obtained by measuring an X ray generated at the portion by applying an X ray to the portion with the scanning electron microscope-energy dispersive X-ray spectrometer.

7 Claims, 5 Drawing Sheets

SHEET HEATER AND IMAGE FIXING DEVICE INCLUDING THE SHEET HEATER

CROSS REFERENCE TO RELATED APPLICATIONS

This application is entitled to and claims the benefit of Japanese Patent Application No. 2012-188464, filed on Aug. 29, 2012, the disclosure of which including the specification, drawings and abstract is incorporated herein by reference in its entirety.

BACKGROUND OF THE INVENTION

1. Field of the Invention

The present invention relates to a sheet heater and an image fixing device including the sheet heater.

2. Description of Related Art

Image forming apparatus such as copiers and laser beam printers have a built-in image fixing device. The image fixing device includes a heater that is allowed to come into pressure-contact with an unfixed image to form a fixed image (see, for example, Japanese Patent Application Laid-Open Nos. 2006-294604, 2009-92785, and 2009-109987). The heater is provided as a heat fixing belt as illustrated in FIGS. 5A and 5B, for example. Heat fixing belt 10 in FIGS. 5A and 5B is a pipe-shaped member, and includes first insulation layer 1, specific resistance heater layer 2, second insulation layer 3, releasing layer 4, and electrode layer 5. FIG. 5A is a sectional view of heat fixing belt 10 taken along the axial direction of the pipe, and FIG. 5B is a sectional view taken along the line II-II in FIG. 5A.

Specific resistance heater layer 2 of heat fixing belt 10 includes a polyimide resin as a matrix resin, and conductive materials such as fine metal particles and carbon materials. In addition, electrode layer 5 is formed by applying, for example, a conductive paste containing a polyimide, resin as a matrix resin on specific resistance heater layer 2.

As described above, it has been known in the art to employ a conductive paste to form an electrode layer of a heat fixing belt. However, the electrode layer formed of a conductive paste occasionally has low mechanical strength. In addition, a voltage of 100 to 240 V is typically applied to the electrode layer, causing the temperature of the heat fixing belt to rise above 200° C. When the supply of electricity is stopped, the heat fixing belt is cooled down to normal temperature in several seconds. The heat fixing belt undergoes such harsh environmental changes. Thus, cracks and may be formed as a result of repetitive use and defect holes may be formed t as a result of sparks in the heat fixing belt.

To counter the foregoing drawback, it is conceivable to adopt a metal plate as the electrode layer of the heat fixing belt. With such a configuration, however, the electrode layer formed of a metal plate and a specific resistance heater layer are occasionally separated from each other when the belt is repeatedly used.

SUMMARY OF THE INVENTION

It is an object of the present invention to provide a sheet heater that exhibits high adhesion strength between a sheet article composed of a conductive resin composition containing a conductive material and a resin, and a pair of metal plate electrodes bonded to sheet article, as well as less performance reduction caused by repetitive use.

It is another object of the present invention to provide an image fixing device including the sheet heater.

In order to achieve at least one of the objects, a sheet heater reflecting one aspect of the present invention is provided as follows.

[1] A sheet heater including:

a sheet article composed of a conductive resin composition containing a conductive material and a resin; and a pair of metal plate electrodes, one of the electrodes being bonded to one end of the sheet article, the other electrode being bonded to the other end of the sheet article, wherein when elements of the sheet article are detected at a portion 1 μm depth from a surface of the metal plate electrode, a peak area ratio of silicon (Si) to metal ion (M) is 1/100 to 1, the metal ion M being most abundant of all metal ions detected at the portion, the peaks being obtained by measuring an X ray generated at the portion by applying an X ray to the portion with the scanning electron microscope-energy dispersive X-ray spectrometer.

[2] The sheet heater according to [1], wherein the metal plate electrodes are bonded to respective ends of the sheet article by a silane coupling agent.

[3] The sheet heater according to [1], wherein the resin is a polyimide resin.

[4] The sheet heater according to [1], wherein the sheet article is a pipe-shaped article, and the pair of metal plate electrodes each having a ring shape and being bonded to respective ends of the pipe-shaped article.

[5] The sheet heater according to [1], wherein the sheet article includes an elastic layer that covers an external surface of the sheet article.

[6] The sheet heater according, to [1], wherein, the sheet article includes a releasing layer that covers an external surface of the sheet article.

In addition, an image fixing device reflecting one aspect of the present invention is provided as follows.

[7] An image fixing device including the sheet heater according to [1].

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, an embodiment of the present invention will be described in detail with reference to the drawings.

1. Sheet Heater

Figure 1A:
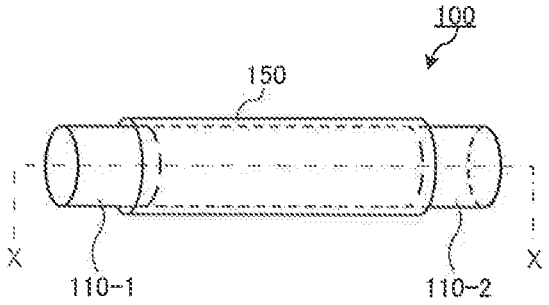
FIGS. 1A and 1B illustrate an exemplary configuration of a sheet heater according to an embodiment of the present invention.
Figure 1B:
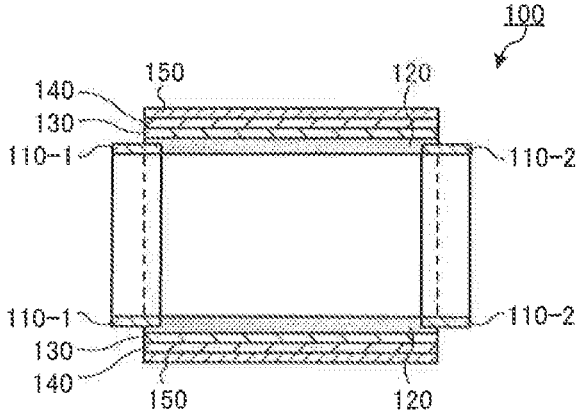

A sheet heater according to an embodiment of the present invention includes at least a sheet article composed of a conductive resin composition, and a pair of metal plate electrodes bonded to both ends of the sheet article. One of the electrodes is bonded to one end of the sheet article, and the other electrode is bonded to the other end of the sheet article. The sheet heater may also include a reinforcement layer, an elastic layer, and a releasing layer which cover the external surface of the sheet article. FIGS. 1A and 1B illustrate an exemplary configuration of the sheet heater according to an embodiment of the present invention. FIG. 1A is a perspective view of an external appearance of sheet heater 100, and FIG. 1B is a sectional view taken along the line X-X of sheet heater 100 in FIG. 1A. Sheet heater 100 illustrated in FIGS. 1A and 1B has a pipe shape, and includes metal plate electrodes 110-1 and 110-2, sheet article 120, reinforcement layer 130, elastic layer 140, and releasing layer 150 which are laminated in the presented order from the internal side of the sheet heater.

Pipe-shaped sheet heater 100 illustrated in FIGS. 1A and 1B has an inner diameter of 10 to 120 mm, for example, when sheet heater 100 is used as a fixing member of a typical image fixing device. The inner diameter is appropriately set as necessary.

The pair of metal plate electrodes are preferably jointed to ends of the sheet heater. The sheet heater is configured to generate heat when a potential difference is applied between the metal plate electrodes. Examples of the material of the metal plate electrode include stainless steel (SUS), aluminum, copper, silver, iron, and nickel, with stainless steel or nickel being preferable because of their low electrical resistivity and high resistance to heat and oxidation. In particular, stainless steel is more preferable.

Stainless steels include a chromium steel which is an iron-chromium alloy, a chromium-nickel steel which is an iron-chromium-nickel alloy. Metal plate electrodes 110-1 and 110-2 of pipe-shaped sheet heater 100 illustrated in FIG. 1 preferably have a ring-shape since sheet article 120 has a pipe-shape. Preferably, the ring-shaped metal plate electrode has a thickness smaller than that of the sheet article, and, for example, has a thickness of 20 to 200 μm.

The sheet article is composed of a conductive resin composition which contains a conductive material and a resin. The content of the resin in the conductive resin composition constituting the sheet article is preferably 30 to 80 wt %, and the content of the conductive material in the conductive resin composition is preferably 20 to 70 wt %.

The resin contained in the conductive resin composition which is the sheet article used in the present invention is preferably a heat-resistant resin such as a polyimide resin. A polyimide resin is a condensation polymer of a diamine and a tetracarboxylic dianhydride. The resin contained in the conductive resin composition may contain a second resin other than the polyimide resin.

The diamine that constitutes the polyimide resin is preferably an aromatic diamine. Examples of the aromatic diamine include paraphenylenediamine, metaphenylenediamine, 2,5-diaminotoluene, 2,6-diaminotoluene, 4,4'-diaminobiphenyl, 3,3'-dimethyl-4,4'-biphenyl, 3,3'-dimethoxy-4,4'-biphenyl, 2,2-bis(trifluoromethyl)-4,4'-diaminobiphenyl, 3,3'-diaminodiphenylmethane, 4,4'-diaminodiphenylmethane, 2,2-bis(4-aminophenyl)propane, 3,3'-diaminodiphenylsulfone, 4,4'-diaminodiphenylsulfone, 3,3'-diaminodiphenylsulfide, 4,4'-diaminodiphenylsulfide, 3,3'-diaminodiphenylether, 3,4'-diaminodiphenylether, 4,4'-diaminodiphenylether, 1,5-diaminonaphthalene, 4,4'-diaminodiphenyldiethylsilane, 4,4'-diaminodiphenylsilane, 4,4'-diaminodiphenylethylphosphineoxide, 1,3-bis(3-aminophenoxy)benzene, 1,3-bis(4-aminophenoxy)benzene, 1,4-bis(4-aminophenoxy)benzene, bis[4-(3-aminophenoxy)phenyl]sulfone, bis[4-(4-aminophenoxy)phenyl]sulfone, 2,2-bis[4-(4-aminophenoxy)phenyl]propane, 2,2-bis(3-aminophenyl)1,1,1,3,3,3-hexafluoropropane, 2,2-bis(4-aminophenyl)1,1,1,3,3,3-hexafluoropropane, and 9,9-bis(4-aminophenyl)fluorine.

The tetracarboxylic dianhydride that constitutes the polyimide resin is preferably an aromatic tetracarboxylic dianhydride. Examples of the aromatic tetracarboxylic dianhydride include pyromellitic dianhydride, 1,2,5,6-naphthalene tetracarboxylic dianhydride 1,4,5,8-naphthalene tetracarboxylic dianhydride, 2,3,6,7-naphthalene tetracarboxylic dianhydride, 2,2',3,3'-biphenyl tetracarboxylic dianhydride, 2,3,3',4'-biphenyl tetracarboxylic dianhydride, 3,3',4,4'-biphenyl tetracarboxylic dianhydride, 2,2',3,3'-benzophenone tetracarboxylic dianhydride, 2,3,3',4'-benzophenone tetracarboxylic dianhydride, 3,3',4,4'-benzophenone tetracarboxylic dianhydride, bis(3,4-dicarboxyphenyl)sulfone dianhydride, bis(2,3-dicarboxyphenyl)methane dianhydride, bis(3,4-dicarboxyphenyl)methane dianhydride, 1,1-bis(2,3-dicarboxyphenyl)ethane dianhydride, 1,1-bis(3,4-dicarboxyphenyl)ethane dianhydride, 2,2-bis[3,4-(dicarboxyphenoxy)phenyl]propane dianhydride, 4,4'-(hexafluoroisopropylidene)diphthalic anhydride, oxydiphthalic anhydride, bis(3,4-dicarboxyphenyl)sulfone dianhydride, bis(3,4-dicarboxyphenyl)sulfoxide dianhydride, thiodiphthalic anhydride, 3,4,9,10-perylene tetracarboxylic dianhydride, 2,3,6,7-anthracene tetracarboxylic dianhydride, 1,2,7,8-phenanthrene tetracarboxylic dianhydride, 9,9-bis(3,4-dicarboxyphenyl)fluorene dianhydride, and 9,9-bis[4-(3,4'-dicarboxyphenoxy)phenyl]fluorene dianhydride.

In addition, the above-described second resin is preferably a heat-resistant resin which has a short-term heat resistance of 200° C. or above, and a long-term heat resistance of 150° C. or above. Examples of such a heat-resistant resin include polyphenylene sulfide resin (PPS), polyarylate resin (PAR), polysulfone resin (PSF), polyether sulfone resin (PES), polyetherimide resin (PEI), polyamideimide (PAI), and polyetheretherketone resin (PEEK).

The short-term heat resistance refers to an upper limit temperature at which the physical property of the resin can be maintained. The long-term heat resistance refers to a certain temperature at which the initial physical property is halved in value when the resin is exposed at that certain temperature to the atmosphere for 100,000 hours. It is particularly preferable that the content of the second resin be equal to or less than 50 vol % of the whole resin constituting the conductive resin composition.

In addition, the resin may include a third resin other than the above-mentioned heat-resistant resin. It is particularly preferable that the content of the third resin be less than 40 vol % of the whole resin constituting the conductive resin composition.

The conductive materials contained in the conductive resin composition are dispersed in the resin. Examples of the conductive materials include conductive particles of various forms and various particle sizes; examples thereof include carbon particles of graphite, carbon black, carbon nanotube, and carbon micro coil; metal particles such as nickel powder and silver powder; metal alloy particles such as stainless-steel powder; intermetallic compounds such as tungsten carbide, tantalum carbide, and tungsten boride; and metal coated powders such as silver coated carbon powder. The conductive material may alternatively have a fibrous form, for example.

Since the sheet article functions as a heat generation layer, it suffices to set the thickness of the sheet article such that a desired amount of heat can be obtained, and it is preferable to set the thickness in accordance with the amount and kind of the conductive material contained in the sheet article, the width of the region in which the sheet article is in contact with the metal plate electrode, and the like. As described above, however, it is preferable that the thickness of the sheet article be greater than that of the metal plate.

When metals and silicon of the sheet article are detected with an SEM-EDS (for scanning electron microscope-energy dispersive X-ray spectrometer) at a portion 1 μm depth from the surface of the metal plate electrode, the peak area ratio of silicon (Si) to metal (M) which is most abundant of all metal elements detected is 1/100 to 1. The peaks are obtained by measuring X rays generated at the above-mentioned portion when an X ray is applied thereto with the SEM-EDS. SEM-EDS is a scanning electron microscope that detects a characteristic X-ray as generated from a sample when an electron beam is applied to the sample and provides information on the presence/absence and amount of elements in the sample. For example, the SEM-EDS has a resolution of 0.5 to 4 nm and can offer images of high magnification and high resolution in units of 10 nm. The SEM-EDS can identify and quantify not only elements on the surface of the sample but also elements at approximately 15 μm depth from the surface of the sample. Metals are typically detected as metal ions.

When the peak area ratio (Si/M) is smaller than 1/100, the adhesion strength between the metal plate electrode and the sheet article may not be obtained sufficiently. When the peak area ratio is greater than 1, a silicon-containing layer may be formed between the metal plate electrode and the sheet article, and thus the metal plate electrode and the sheet article may be separated from each other.

A sample for SEM-EDS can be prepared by polishing a portion of the sheet article that overlaps the metal plate electrode so as to expose a portion 1 μm depth from the surface of the metal plate electrode. The SEM-EDS measurement may be either a single or a multi-point measurement. An average of multi-point measurements may be used.

The sheet heater may have a reinforcement layer that covers the sheet article. The reinforcement layer preferably includes a heat-resistant resin, and the reinforcement layer may be made of a resin similar to that contained in the sheet article, for example. In the case where the thickness of the sheet article is small and thus the mechanical strength thereof is insufficient, the strength of the sheet heater can be increased by providing the reinforcement layer.

The sheet heater may have an elastic layer that covers the sheet article, or covers the reinforcement layer when the reinforcement layer is employed. The elastic layer preferably contains a soft rubber having low hardness such as a silicone rubber, for example. More specifically, for example, it is preferable to use a silicone rubber having a JIS-A hardness of 3 to 50 degrees. The thickness of the elastic layer is preferably 100 to 500 μm. Providing the elastic layer can improve image quality without causing uneven fixation and uneven gloss when the sheet heater is used as a fixing member of an image fixing device.

It is preferable that the sheet heater have a releasing layer that covers the sheet article, or covers the reinforcement layer when the reinforcement layer is employed, or covers the elastic layer when the elastic layer is employed. The releasing layer is disposed as an outermost layer of the sheet heater. It is preferable that the releasing layer include a fluorine resin or a fluorine rubber, in particular, a fluorine resin. Examples of the fluorine resin include polytetrafluoroethylene (PTFE), tetrafluoroethylene-perfluoroalkyl vinyl ether copolymer (PFA), and tetrafluoroethylene-hexafluoropropylene copolymer (FEP), which can be used alone or in combination. The thickness of the releasing layer is preferably 5 to 30 μm, more preferably, 10 to 20 μm. Providing the releasing layer reduces the possibility that, in the case where the sheet heater is used as a fixing member of an image fixing device, an image transfers onto the fixing member, since the releasing layer directly makes contact with the image.

A method of manufacturing the sheet heater according to an embodiment of the present invention includes: step A of applying a silane coupling agent on the surface of each metal plates of a pair of metal plates, step B of setting the metal plates on a supporting member, and step C of applying a conductive resin dope onto the outer surface of the metal plates and the supporting member to form a heat generation layer (which corresponds to the sheet article). The manufacturing method may further include: step D of laminating a reinforcement layer, an elastic layer, and a releasing layer on the heat generation layer, and step E of removing the supporting member. As a matter of course, the manufacturing method according to an embodiment of the present invention is not limited as long as the sheet heater can be obtained.

In the silane coupling agent, a functional group A which acts on the resin in the conductive resin composition, and a functional group B for generating silanol which acts on the metal material of the metal plate electrode, are linked with each other by a silicon atom. The numbers of the functional group A and functional group B in the silane coupling agent are not specifically limited. The silane coupling agent may further contain other functional group(s) than the functional group A and functional group B (for example, a functional group such as an alkyl group that adjusts hydrophobicity and the like).

The silane coupling agent can be represented by general formula (A), for example. In formula (A), X corresponds to the above-described functional group A, and is vinyl group, epoxy group, amino group, (meth)acrylic group, halogen atom, isocyanate group, or mercapto group, for example. In formula (A), OR (where O is oxygen atom) corresponds to the above-described functional group B, and is methoxy group or ethoxy group, for example. In formula (A), OR may be the same or different.

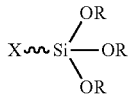

(A)

The silane coupling agent can also be represented by formula (1) or (2).

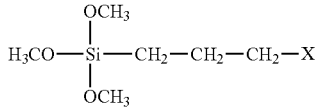

(1)

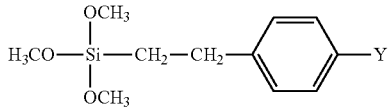

(2)

X in formula (1) represents phenyl group or amino group, and Y formula (2) represents methyl amino group. The compounds represented by formulas (1) and (2) each have a trimethoxysilyl group and two or three methylene groups, a relatively long moiety that links the trimethoxysilyl group with substituent X or Y. Using such a compound as a coupling agent for bonding the metal plate electrode and the resin-containing sheet article can increase the adhesion force between the metal plate electrode and the sheet article, and in particular, can prevent reductions in the adhesion force as well as peeling off due to repeated heat generation.

Specific examples of the silane coupling agent include vinyltrimethoxysilane, vinyltriethoxysilane, 2-(3,4-epoxycyclohexyl)ethyltrimethoxysilane, 3-glycidoxypropyl trimethoxysilane, 3-glycidoxypropyl triethoxysilane, p-styryl trimethoxysilane, 3-methacryloxypropyl trimethoxysilane, 3-methacryloxypropyl triethoxysilane, 3-acryloxypropyl trimethoxysilane, N-2-(aminoethyl)-3-aminopropyl trimethoxysilane, N-2-(aminoethyl)-3-aminopropyl triethoxysilane, 3-aminopropyl trimethoxysilane, 3-aminopropyl triethoxysilane, 3-triethoxysilyl-N-(1,3-dimethyl-butylidene)propyl amine, N-phenyl-3-aminopropyl trimethoxysilane, 3-ureidopropyltriethoxysilane, 3-chloropropyl trimethoxysilane, 3-mercaptopropyl trimethoxysilane, and 3-isocyanatepropyl triethoxysilane.

Figure 2A:
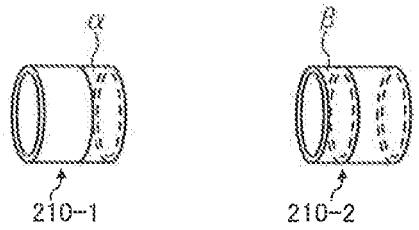
FIGS. 2A to 2E illustrate an exemplary flow for manufacturing the sheet heater.
Figure 2B:
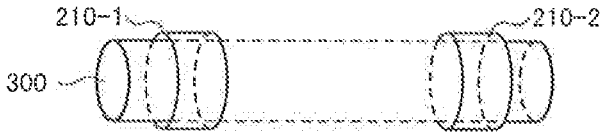
Figure 2C:
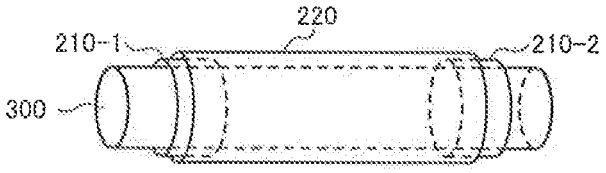
Figure 2D:
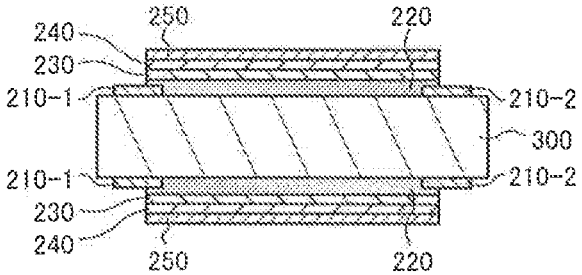
Figure 2E:
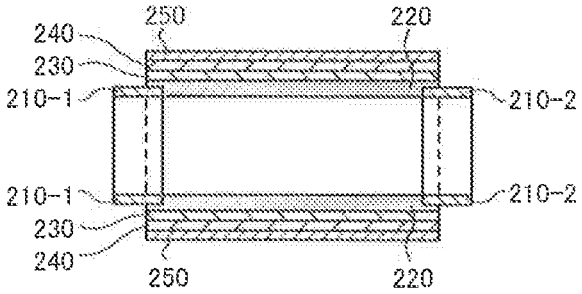

FIGS. 2A to 2E illustrate a flow for manufacturing the sheet heater 100 illustrated in FIGS. 1A and 1B. FIG. 2A illustrates ring-shaped metal plates 210-1 and 210-2 on which the compound represented by formula (1) or formula (2) has been applied. FIG. 2B illustrates a state where ring-shaped metal plates 210-1 and 210-2 are set on supporting member 300 composed of a mandrel. FIG. 2C illustrates a state where a conductive resin dope is applied to the supporting member 300 and metal plates 210-1 and 210-2 in the ring-shape illustrated in FIG. 2B to form heat generation layer 220. FIG. 2D (sectional view) illustrates a state where reinforcement layer 230, elastic layer 240, releasing layer 250 are laminated on heat generation layer 220. FIG. 2E (sectional view) illustrates a state where supporting member 300 has been pulled out of the structure illustrated in FIG. 2D to provide sheet heater 100.

The pair of metal plates 210-1 and 210-2 in step A are members which serve as the pair of metal plate electrodes of the sheet heater, and have a ring shape as illustrated in FIG. 2A for example, but this is not limitative. In step A, a silane coupling agent is applied to the surface of metal plates 210-1 and 210-2. The silane coupling agent can be applied to the metal plate by immersing the metal plate in the liquid silane coupling agent as it is or in a solution containing the silane coupling agent, or by spraying the solution containing the silane coupling agent onto the metal plate, for example.

The silane coupling agent may be applied to a part of the surface, not the entire surface, of each of the metal plates. Specifically, for example, it suffices to apply the silane coupling agent onto at least one side of the metal plate. More specifically, it suffices to apply the silane coupling agent to a region in which the conductive resin dope is applied in step C (see regions $\alpha$ and $\beta$ in FIG. 2A). The amount of the silane coupling agent to be applied is preferably $1\times10^{-3}$ to $1\times10^{-2}$ g/mm$^2$. By increasing the amount of the silane coupling agent to be applied to the metal plate, the peak area ratio (Si/M) can be increased, and by decreasing the amount, the peak area ratio (Si/M) can be decreased.

The supporting member to which the pair of metal plates are attached in step B is not specifically limited as long as it has a form that can support the metal plates. The material of the supporting member is not specifically limited; for example, metals such as stainless steel can be employed. It is preferable to perform pre-treatment for cleaning and smoothing the surface of the supporting member because the supporting member is removed in later step E.

When the metal plate is formed in ring shape, the supporting member is a metal core (mandrel) or the like, and preferably has a diameter that allows the ring-shaped metal plate to be fitted to the supporting member without leaving any gap therebetween. For example, the ring-shaped metal plates may be fitted to the both ends of the mandrel serving as the supporting member (see FIG. 2B).

In step C, a conductive resin dope as a raw material of the sheet article is applied to the surface of the supporting member and the surface of each of the metal plates mounted on the supporting member. The conductive resin dope may contain a resin or a precursor thereof, a conductive material, and a solvent. The conductive material contained in the conductive resin dope may be the same as the conductive material contained in the sheet article. The resin contained in the conductive resin dope may be the same as the resin contained in the sheet article, and is a polyimide resin or the like, for example. For example, the precursor of the resin is a polyimide precursor such as polyamic acid.

The solvent contained in the conductive resin dope is not specifically limited, and preferable examples of the solvent combined with the polyamic acid as the polyimide precursor include N,N-dimethylformamide, N,N-dimethylacetamide, N,N-diethylacetamide, N-methyl-2-pyrrolidone, 1,3-dimethyl-2-imidazolidinone, N-methyl caprolactam, hexamethylphosphoric triamide, 1,2-dimethoxyethane, diglyme, and triglyme.

Figure 3:
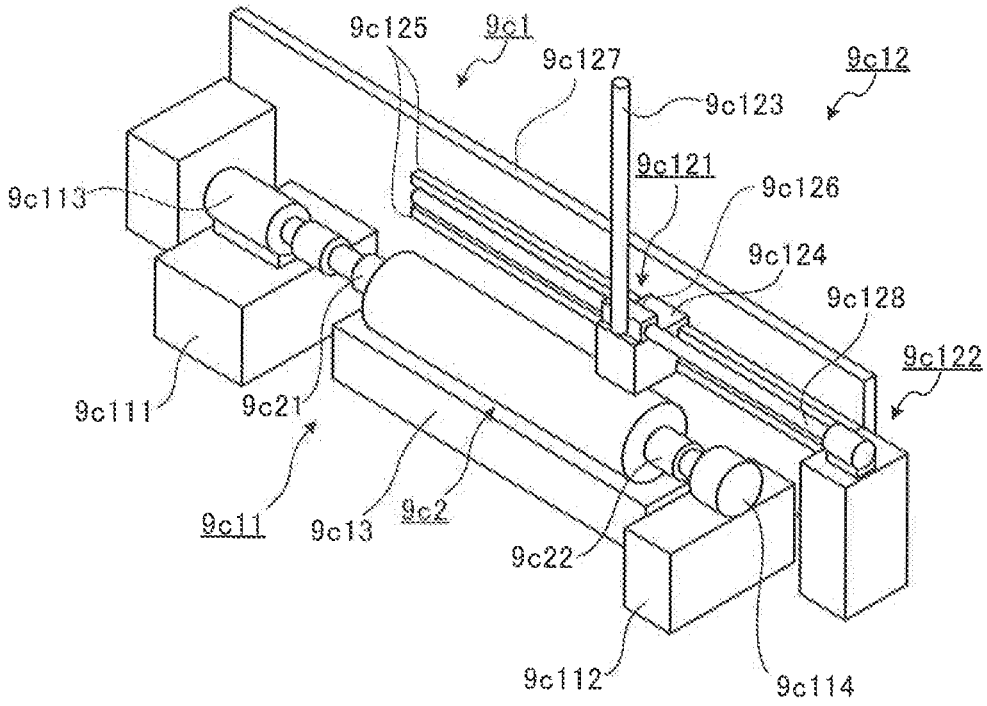
FIG. 3 illustrates a configuration of a coater for applying a conductive resin dope.

Application of the conductive resin dope in step C can be performed with the manufacturing apparatus disclosed in Japanese Patent Application Laid-Open No. 2012-37823, for example. Manufacturing apparatus 9*c*1 includes holding device 9*c*11, application device 9*c*12, and curing device 9*c*13 as illustrated in FIG. 3.

Holding device 9*c*11 uses driving motor 9*c*113 and receiving section 9*c*114 to rotatably hold cylindrical supporting member 9*c*2. Each of two metal plate rings is fitted to each of both ends of cylindrical supporting member 9*c*2. Cylindrical supporting member 9*c*2 is connected to driving motor 9*c*113 and receiving section 9*c*114 via holding members 9*c*21 and 9*c*22. Driving motor 9*c*113 is disposed on first holding stand 9*c*111, and receiving section 9*c*114 is disposed on second holding stand 9*c*112.

Application device 9*c*12 applies conductive resin dope to a circumferential surface of rotating supporting member 9*c*2. Nozzle 9*c*121 applies the conductive resin dope to a circumferential surface of supporting member 9*c*2. Nozzle 9*c*121 is guided by two guide rails 9*c*125 disposed in parallel to an axial direction of supporting member 9*c*2, via mounting section 9*c*124. Guide rails 9*c*125 are mounted to guide rail mounting plate 9*c*127. Nozzle 9*c*121 moves along the axial direction of supporting member 9*c*2 in association with the rotation of male screw 9*c*128 threadedly engaged with female screw 9*c*126 on a nozzle 9*c*121 side. Male screw 9*c*128 is connected to bi-directionally rotatable rotation driving section 9*c*122. The conductive resin dope is supplied to nozzle 9*c*121 through supply tube 9*c*173.

Curing device 9*c*13 is a device that cures the conductive resin dope applied on rotating supporting member 9*c*2. Curing device 9*c*13 is a heater that heats and cures a film of the conductive resin dope, for example.

The thickness of the film of the conductive resin dope can be adjusted by changing the viscosity of the conductive resin dope and/or the rotation speed of supporting member 9*c*2.

After the film of the conductive resin dope is formed, the film is dried and further cured, whereby the heat generation layer configuring the sheet article used in the present invention is formed. Curing refers to a process whereby a polyamic acid is converted into polyimide, for example. Typically, in the processes of steps A to C, the coupling reaction of the silane coupling agent couples together the metal plate electrode and the heat generation layer.

In step C, the conductive resin dope, which is the raw material of the sheet article, may be applied to part or whole of the external surface (exposed surface) of the metal plate set on the supporting member. In either case, the silage coupling agent has already been applied in step A on the surface to which the conductive resin dope is to be applied. In addition, for the purpose of increasing the adhesion force between the surface of metal plate and the heat generation layer, the area in which the metal surface and the heat generation layer overlap each other preferably has a certain size or more (for example, 200 $mm^2$ or more). For the same reason, preferably, the metal surface and the heat generation layer overlap each other by 2 mm or more in the axial direction of the heat generation layer. On the other hand, the region of the metal plate in which the conductive resin dope is not applied serves as a connector for connection with external devices (such as a power source).

In step D, it suffices to laminate the heat generation layer, the reinforcement layer, the elastic layer, and the releasing layer. Coating solutions for the layers are applied, dried, and if necessary, cured with use of the coater illustrated in FIG. 3.

In step E, the supporting member is removed to obtain the sheet heater. The supporting member is in contact with each of the metal plates and the heat generation layer. In order to make the removal of the supporting member easy, it is necessary to prevent the supporting member from adhering to the metal plates and the heat generation layer. Therefore, the silane coupling agent may not be applied to the surface of the metal plate in contact with the supporting member.

2. Application of Sheet Heater

The sheet heater may be used as a member of the image fixing device. The image fixing device is a device for thermally fixing an unfixed toner image in an electrophotography image forming apparatus, for example.

Figure 4:
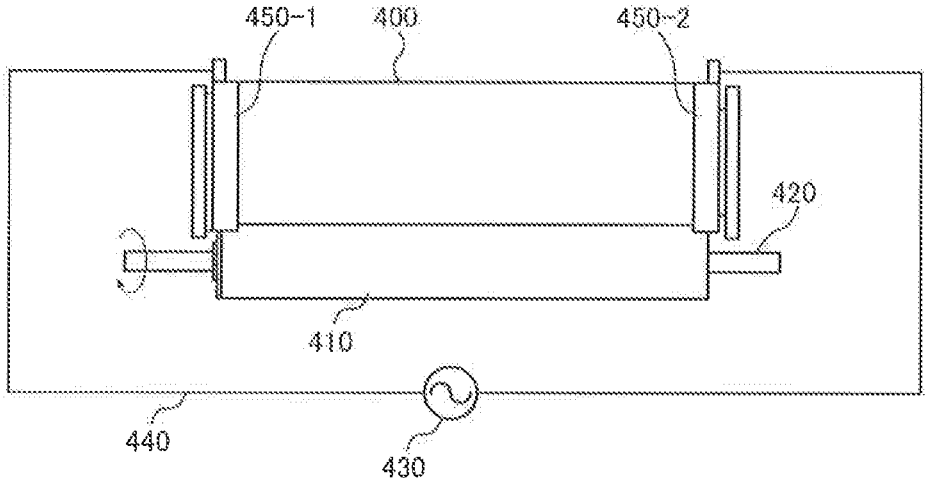
FIG. 4 illustrates an exemplary configuration of the image fixing device according to an embodiment of the present invention.
Figure 5A:
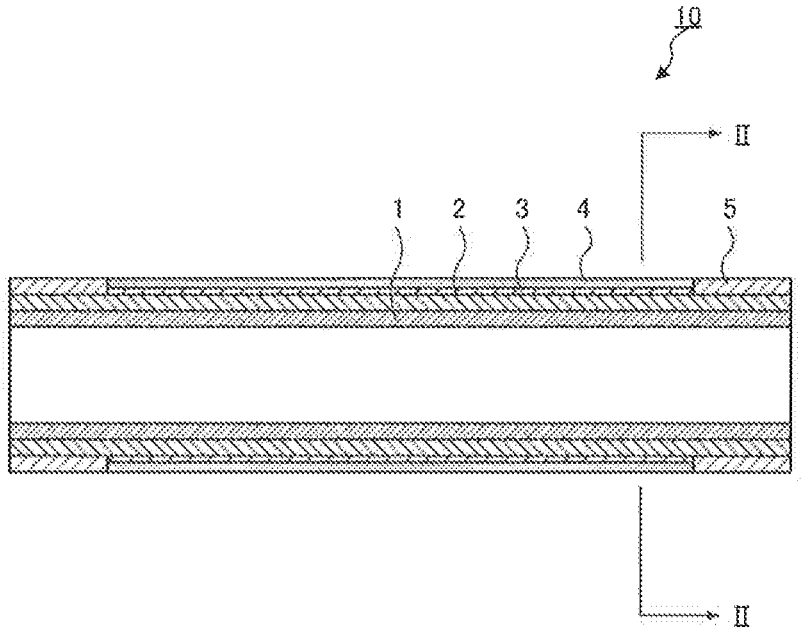
FIGS. 5A and 5B illustrate a configuration of a conventional heat fixing belt.
Figure 5B:
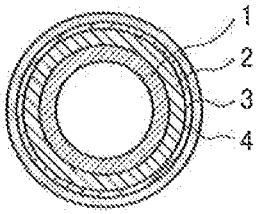

FIG. 4 illustrates an exemplary image fixing device. The image fixing device illustrated in FIG. 4 has pipe-shaped sheet heater 400, pressure roll 410, shaft 420 of pressure roll 410, power source 430, and lead 440. Shaft 420 of pressure roll 410 is coupled to a drive motor (not illustrated).

The sheet heater of the present invention may be used as sheet heater 400 of the image fixing device illustrated in FIG. 4. A pair of electrodes (metal plate electrodes) 450-1 and 450-2 provided at both ends of sheet heater 400 supply electricity to the heat generation layer of sheet heater 400 to cause the heat generation layer to generate heat. In the image fixing device illustrated in FIG. 4, when pressure roll 410 rotates, also sheet heater 400 in pressure contact with pressure roll 410 rotates along with the rotation of the pressure roll 410, and copy sheets on which an unfixed image is formed are sequentially sent to a nip portion formed between pressure roll 410 and sheet heater 400 for heat fixing.

As described above, in the present embodiment, metal ion contents and Si atom content at a connecting portion between the metal plate electrode and the sheet article are quantitatively identified according to the peak area ratio of metal to Si as detected by SEM-EDS. The peaks are detected by applying an X ray to the connecting portion. In the present embodiment, a favorable adhesion force at the connector is ensured, and the sheet heater having electrical characteristics (conductivity or insulation property) that offer an optimal heating temperature for toner fixing is achieved.

EXAMPLES

Preparation of Metal Plate Electrode

A commercial SUS304 plate having a thickness of 50 μm was processed by a known method to form a ring-shaped metal plate electrode having a width of 20 mm and an inner diameter of 30.05 mm. The ring-shaped metal plate electrode was:

(1) ultrasonically washed in acetone for 30 min;

(2) etched with 10% hydrochloric acid aqueous solution at room temperature for 10 min; and (3) washed with tap water, and then deionized water.

The resulting metal plate electrode was used as metal plate electrode 1.

Each end (15 mm) of metal plate electrode 1 was immersed in a solution of compound 3 represented by formula (3) given below for 1 min and dried in a hot-blast stove for 3 min. The resulting metal plate electrode was used as metal plate electrode 2.

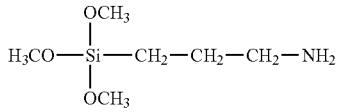

(3)

Each end (15 min) of metal plate electrode 1 was immersed in a solution of compound 4 represented by formula (4) given below for 1 min and dried in a hot-blast stove for 3 min. The resulting metal plate electrode was used as metal plate electrode 3.

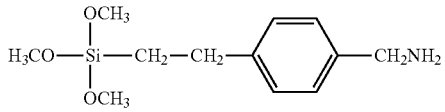

(4)

Each end (15 mm) of metal plate electrode 1 was immersed in the solution of compound 3 for 1 min and dried in a hot-blast stove for 3 min. Metal plate electrode 1 was again immersed at both ends and dried. In this way compound 3 was applied twice to each end of the ring. The resulting metal plate electrode was used as metal plate electrode 4.

Each end (15 mm) of metal plate electrode 1 was immersed in a 1% alcohol solution of compound 3 for 1 min and dried in a hot-blast stove for 3 min. The resulting metal plate electrode was used as metal plate electrode 5.

[Preparation of Dope Solution for Heat Generation Layer]

A dope solution for heat generation layer for forming the sheet article (i.e., a solution for conductive resin containing resin raw material and conductive material) was prepared in the following procedure.

18 g of commercial graphite fiber XN-100 (available from Nippon Graphite Fiber Corporation), a conductive material, was placed into 100 g of polyamic acid solution (LT-Varnish S301 available from Ube industries, Ltd.), a polyimide resin precursor, followed by mixing with stirring at 5,000 rpm for 15 min by Homo Mixer Mark II Model 2.5 available from Primix Corporation. The mixture thus obtained was used as the dope solution for heat generation layer.

[Preparation of Coating Solution for Forming Elastic Layer]

Silicone rubber KE1379 (available from Shin-Etsu Chemical Co., Ltd.) and silicone rubber DY356013 (available from Dow Corning Toray Silicone Co., Ltd.) were mixed at a ratio of 2:1 (silicone rubber KE1379: silicone rubber DY356013, mass ratio). The viscosity of the mixture, as measured at 25° C. with TVB10 available from Toki Sangyo Co., Ltd, was 50

Pa·s. The mixture thus obtained was used as the coating solution for forming the elastic layer.

[Preparation of Coating Solution for Forming Releasing Layer]

PTFE resin and PFA resin were mixed at a mass ratio of 7:3 (PTFE resin:PFA resin) to prepare a fluorine resin dispersion (available under the trade name "855-510" from E. I. du Pont de Nemours and Company) adjusted to have a solid concentration of 45% and a viscosity of 110 mPa·s was prepared as the coating solution for forming the releasing layer.

Example 1

Preparation of Heat Generation Layer and Reinforcement Layer

Metal plate electrode 2 was attached to both ends of a mandrel made of a stainless steel having a length of 380 mm and an outer diameter of 30.0 mm. Metal plate electrode 2 was attached to the mandrel such that the portion where compound 3 has been applied is positioned nearer to the center of the mandrel. Next, the dope solution for the heat generation layer was applied to the outer peripheral surface of metal plate electrode 2 and the outer peripheral surface of the mandrel, except for ends (non-application portion) of metal plate electrode 2 which serve as electrodes for supplying electricity. The dope solution for the heat generation layer was applied to a thickness of 0.8 mm using the apparatus illustrated in FIG. 3 under the condition described below. After application, with the mandrel being rotated at a rotational speed of 40 rpm, the mandrel was heated at 120° C. for 40 min to dry the dope solution thus applied. Next, in a similar manner, in place of the dope solution, a polyamic acid solution (U-Varnish S301 available from Ube Industries, Ltd.) was applied to a thickness of 0.8 mm on top of the coat of the dope solution. Thereafter, with the mandrel being rotated at a rotational speed of 40 rpm, the mandrel was heated at 120° C. for 40 min to dry the polyamic acid solution applied thereto. Thereafter, the mandrel on which the solutions have been applied was heated at 450° C. for 20 min to form a heat generation layer and a reinforcement layer of the heat fixing belt. It is to be noted that the rotational speed of the mandrel was measured by HT-4200 available from Ono Sokki Co., Ltd.

(Application Condition)

Temperature of coating solutions (dope solution for heat generation layer and polyamic acid solution): 25° C.

Shape of discharge port of nozzle: conical shape

Caliber of discharge port of nozzle: 2 mm

Distance between discharge port of nozzle and circumferential surface of mandrel: 5 mm Discharge rate of coating solution from nozzle: 5 mL/mm Travel speed of nozzle along rotational axis of mandrel: 1 mm/sec Rotational speed of mandrel: 40 rpm (Preparation of Elastic Layer)

In place of the polyamic acid solution, the coating solution for forming the elastic layer was applied on the reinforcement layer with use of the apparatus illustrated in FIG. 3 under the condition described below, and then dried to form a coated film for forming the elastic layer. Thereafter, with the mandrel being rotated at a rotational speed of 40 rpm, a primary vulcanization was performed at 150° C. for 30 min, and further post vulcanization was performed at 200° C. for 4 hours to form an elastic layer on the reinforcement layer.

(Application Condition)

Temperature of coating solution for forming elastic layer: 25° C.

Shape of discharge port of nozzle: conical shape

Caliber of discharge port of nozzle: 2 mm

Distance between discharge port of nozzle and circumferential surface of reinforcement layer: 5 mm Discharge rate of coating solution for forming elastic layer from nozzle: 5 mL/min Travel speed of nozzle along rotational axis of mandrel: 1 mm/sec Rotational speed of mandrel: 40 rpm (Preparation of Releasing Layer)

In place of the coating solution for forming the elastic layer, the coating solution for forming the releasing layer was applied on the elastic layer with use of the apparatus illustrated in FIG. 3 under the condition described below, and then dried to form the film for forming the releasing layer. Thereafter, the film was dried at room temperature for 30 min, and with the mandrel being rotated at a rotational speed (circumferential velocity) of 0.1 m/sec, the film was heated at 230° C. for 30 min, and further heated at 270° C. for 10 min to form a releasing layer on the elastic layer.

(Application Condition)

Temperature of coating solution for forming releasing layer: 25° C.

Shape of discharge port of nozzle: conical shape

Caliber of discharge port of nozzle: 2 mm

Distance between discharge port of nozzle and circumferential surface of heat generation layer: 5 mm Discharge rate of coating solution for forming releasing layer from nozzle: 5 mL/min Travel speed of nozzle along rotational axis of mandrel: 1 mm/sec Rotational speed of mandrel: 40 rpm The tensile strength of the releasing layer was 10 MPa. The tensile strength of the releasing layer was measured with Instron Model 5988 (Instron Japan Co., Ltd.) The coefficient of friction of the releasing layer was 0.1. The coefficient of friction was measured with a portable friction meter "Muse Type: 94i-II (available from Shinto Scientific Co., Ltd.)." It is to be noted that the coefficient of friction is an average value of coefficients of friction measured at 10 to 30 points randomly selected on the releasing layer.

(Pulling Out of Mandrel)

After the releasing layer was formed, the mandrel was cooled and pulled out, whereby the heat fixing belt having the configuration (the heat generation layer/the reinforcement layer/the elastic layer/the releasing layer) illustrated in FIGS. 2D and 2E was prepared.

(Measurement of Si Peak)

(1) Polishing of Heat Fixing Belt

A resin layer positioned on the metal plate electrode of the heat fixing belt was polished.

"Unit type film system super finishing disc type-SM25" available from Nakao Abrasives Co., Ltd., was used to polish the heat fixing belt to expose a portion 1 μm from the surface of the metal plate electrode under the condition described below. The distance between the surface of the metal plate electrode and the polished surface was confirmed with a laser microscope VK-9500 available from Keyence Corporation.

(Condition)

Polishing film: Trizac Diamond Lapping Film 662XA available from 3M Company (granularity: 2 microns and 0.5 microns)

Travel speed: 30 mm/min

Vibration frequency: 450 cpm (2) Measurement of Si Content in Heat Generation Layer Using a scanning electron microscope-energy dispersive X-ray spectrometer (SEM-EDS), which is a scanning electron microscope (SEM) combined with an energy Dispersive X-ray spectrometer (EDS), elements at the portion exposed by polishing the resin layer were analyzed. An X ray was applied on the polished surface of the metal plate electrode for elemental analysis. The peak area ratio of silicon (Si) to metal (M), which metal is most abundant of all detected metals, was determined.

(Durability Assessment)

The electric resistance of the heat fixing belt before and after an endurance test was measured, and the ratio of difference in electric resistance between before and after the endurance was determined. In the endurance test, the heat fixing belt was mounted to bizhubC550 available from Konica Minolta, Inc., and 900,000 copies of an image with a coverage rate of 5% were made. Electrodes for measurement were connected to respective rings at both ends of the heat fixing belt, and the electric resistance of the heat fixing belt was measured. When the separation of the ring and the heat generation layer occurs, the electric resistance is increased. The evaluation was made on the basis of the following criteria:

A: $\{|\text{resistance after endurance}-\text{initial resistance}|/\text{initial resistance}\}\times 100<1\%$ B: $1\%\leq\{|\text{resistance after endurance}-\text{initial resistance}|/\text{initial resistance}\}\times 100<3\%$ C: $\{|\text{resistance after endurance}-\text{initial resistance}|/\text{initial resistance}\}\times 100\geq 3\%$ Results are shown in Table 1.

Example 2 and Comparative Examples 1 to 3

Except that metal plate electrode 2 was replaced by metal plate electrode 3, the heat fixing belt was prepared and assessed as in Example 1 (Example 2).

In addition, except that metal plate electrode 2 was replaced by metal plate electrode 4, the heat fixing belt was prepared and assessed as in Example 1 (Comparative Example 1).

In addition, except that metal plate electrode 2 was replaced by metal plate electrode 5, the heat fixing belt was prepared and assessed as in Example 1 (Comparative Example 2).

In addition, except that metal plate electrode 2 was replaced by metal plate electrode 1, the heat fixing belt was prepared and assessed as in Example 1 (Comparative Example 3).

Results are shown in Table 1.

Comparative Example 4

Except that the metal plate electrode was not used and the heat generation layer was exposed at an end of the mandrel, the heat generation layer, the reinforcement layer, the elastic layer, and the releasing layer were prepared as in Example 1. Then, a silver paste was applied to a portion where the heat generation layer is exposed to prepare the electrode, thereby obtaining the heat fixing belt. The heat fixing belt thus obtained was in assessed as in Example 1. The results are shown in Table 1.

TABLE 1

| | Metal plate electrode | Coupling agent | Peak area ratio | Assessment result |
|---|---|---|---|---|
| Example 1 | Metal plate electrode 2 | Compound 3 | 0.58 | A |
| Example 2 | Metal plate electrode 3 | Compound 4 | 0.62 | A |
| Comparative Example 1 | Metal plate electrode 4 | Compound 3 | 1.16 | B |
| Comparative Example 2 | Metal plate electrode 5 | Compound 3 | 0.007 | B |
| Comparative Example 3 | Metal plate electrode 1 | — | — | C |
| Comparative Example 4 | Silver paste | — | — | C |

It can be seen that, in the heat fixing belts of Examples, the rate of change in electric resistance between before and after the endurance test was lower than 1%, which is considerably low. It can be said that the low rate is due to the fact that the adhesion condition between the electrode and the heat generation layer has not been changed.

INDUSTRIAL APPLICABILITY

In the sheet heater according to an embodiment of the present invention, the adhesion force between the metal plate electrode and the heat generation layer (sheet article) is great, and therefore the separation of the metal electrode and the heat generation layer is not likely to occur even when the sheet heater undergoes a repeated cycle of heating and cooling. Therefore, the sheet heater is suitable for use as the fixing member of an image fixing device in image forming apparatus.

What is claimed is:

1. A sheet heater comprising:

a sheet article composed of a conductive resin composition containing a conductive material and a resin; and a pair of metal plate electrodes, one of the electrodes being bonded to one end of the sheet article, the other electrode being bonded to the other end of the sheet article, wherein when elements of the sheet article are detected at a portion 1 μm depth from a surface of the metal plate electrode, a peak area ratio of silicon (Si) to metal ion (M) is 1/100 to 1, the metal ion M being most abundant of all metal ions detected at the portion, the peaks being obtained by measuring an X ray generated at the portion by applying an X ray to the portion with the scanning electron microscope-energy dispersive X-ray spectrometer.

2. The sheet heater according to claim 1, wherein the metal plate electrodes are bonded to respective ends of the sheet article by a silane coupling agent.

3. The sheet heater according to claim 1, wherein the resin is a polyimide resin.

4. The sheet heater according to claim 1, wherein the sheet article is a pipe-shaped article, and the metal plate electrodes each having a ring shape and being bonded to respective ends of the pipe-shaped article.

5. The sheet heater according to claim 1, wherein the sheet article includes an elastic layer that covers an external surface of the sheet article.

6. The sheet heater according to claim 1, wherein the sheet article includes a releasing layer that covers an external surface of the sheet article.

7. An image fixing device comprising the sheet heater according to claim 1.

* * * * *